United States Patent [19]

Malone, Sr. et al.

[11] 4,160,528

[45] Jul. 10, 1979

[54] CARPET ROLL WINDING APPARATUS

[75] Inventors: Fermer A. Malone, Sr., Kemp; Fermer A. Malone, Jr., Duncanville, both of Tex.

[73] Assignee: F. A. Malone & Son, Inc., Cedar Hill, Tex.

[21] Appl. No.: 867,283

[22] Filed: Jan. 5, 1978

[51] Int. Cl.[2] ..... B65H 19/20; B65H 17/08

[52] U.S. Cl. ..... 242/56 R; 242/66

[58] Field of Search ..... 242/56 R, 56 A, 57.1, 242/66, DIG. 3

[56] References Cited

U.S. PATENT DOCUMENTS

| | | | |
|---|---|---|---|
| 2,635,826 | 4/1953 | Kuzinski | 242/57.1 |
| 3,228,620 | 1/1966 | Lee | 242/56 R |
| 3,386,678 | 6/1968 | Malone | 242/66 X |
| 3,537,662 | 11/1970 | Keesling | 242/56 R |
| 3,561,693 | 2/1971 | Hlyafe | 242/57.1 |
| 3,917,183 | 11/1975 | Malone | 242/56 R |
| 3,931,940 | 1/1976 | Raighn | 242/56 R |

*Primary Examiner*—Edward J. McCarthy

*Attorney, Agent, or Firm*—Joseph H. Schley; Thomas L. Cantrell

[57] ABSTRACT

An apparatus for unwinding, measuring and cutting a predetermined length of pliable material, such as carpet, from a supply roll and for rewinding the unwound length into a roll, having unwind (first) means for rotatably supporting the supply roll and unwinding and advancing said material to a support (second) means which receives and supports said advanced unwound material during measuring and cutting of the predetermined length therefrom. The support (second) means includes cutting means and coacting holddown means for preventing relative movement of said material during cutting of said predetermined length, the cutting means being mounted for pivotal movement about an upright axis relative to said unwind (first) means so as to permit squaring or alignment thereof with the transverse axis of said unwound length of material; rewind (third) means receives the severed length of material from support (second) means and has means for rotatably supporting said severed length during rewinding thereof into a roll, the rotatable supporting means of rewind (third) means being mounted for pivotal movement about an upright axis relative to said severed material so as to permit the maintenance of the transverse ends of said severed length of material vertically aligned during the rewinding thereof. Unwind (first) means includes means for ejecting the supply roll therefrom after the unwinding and cutting of the desired yardage therefrom, and the rotatable supporting means of rewind (third) means has an outer portion mounted for pivotal movement about a horizontal axis so as to permit arcuate movement of the outer portion of said rotatable means between an upper roll supporting position and a lower roll dumping position.

18 Claims, 10 Drawing Figures

CARPET ROLL WINDING APPARATUS

BACKGROUND OF THE INVENTION

This invention relates generally to the handling of heavy rolls of pliable material and more particularly to apparatus for unwinding carpet from a bulky supply roll, rotatably supporting and advancing, measuring and cutting a predetermined length of carpet, and rewinding the cut length into a roll. It is essential that the cutting of the carpet be squared relative to or aligned with the transverse axis of said carpet, and that the longitudinal margins or lateral ends of the cut length of material be maintained in vertical alignment during the rewinding thereof. Some types of carpets are cumbersome and difficult to handle due to their loose weave or porosity.

Heretofore, the handling of supply rolls or carpet and other pliable material to cut and rewind desired lengths therefrom has become expensive as a result of the necessity of replacing labor with automation which, usually, is so complex that it cannot be afforded by the average handler of carpet. More simple and less costly mechanisms frequently require excessive labor and cannot be successfully operated by one person and/or used to handle loosely woven and/or bulky carpet or similar material.

The pertinent prior art includes the following U.S. Pat. Nos.:

Kuminski—2,635,826;
Lee—3,228,620;
Malone—3,386,678;
Ulyate—3,561,693;
Keesling et al.—3,537,662; ;
Malone—3,917,183;
Raighn et al.—3,931,940.

SUMMARY OF THE INVENTION

An apparatus for unwinding, measuring and cutting a predetermined length of carpet or other pliable material from a supply roll and for rewinding the severed length of material into a roll. This apparatus is composed of three coacting means, mechanisms or sections capable of being operated by one person. The first of these sections has a cradle assembly comprised of a multiplicity of coacting driven rollers for rotatably supporting and unwinding a predetermined length of pliable material as well as advancing said length of material to a second or center section which includes a cutter assembly mounted for pivotal movement about an upright axis relative to the supply roll so as to permit squaring or alignment of the cutter assembly with the transverse axis of said advanced material and a coacting holddown mechanism for preventing relative movement of said material during the cutting of said predetermined length therefrom. A conventional meter for measuring the material as well as control or switch means are adapted to be mounted on the center or second section which also supports said material during the measuring and cutting thereof.

The third of the apparatus sections has a multiplicity of driven rollers coacting to provide cradle assembly for rotatably supporting the material and rewinding the severed length thereof. This cradle assembly is mounted for pivotal movement about an upright axis relative to the unwound severed length of material during rewinding thereof into a roll whereby "coning" or misalignment of the transverse ends of the convolutions of the rewound roll may be prevented. The cradle assemblies of the first or unwind and third or rewind sections are adapted to be driven at the same constant speed whereby the leading portion of the advancing material is drawn from the center or second section into the cradle assembly of said rewind third section during measurement of said material as well as after cutting of the desired length. Preferably, the outermost cradle roller of the rewind third section is mounted for relative pivotal movement about a horizontal axis whereby said outermost roller may be swung from its upper roll supporting position to a lower position so as to facilitate dumping or removal of the rewound material from the cradle assembly of said section.

Also, it is most desirable to provide this rewind section with roll forming means, such as arcuate rocker arms mounted on a rock shaft, pivotal about a horizontal axis into and out of the cradle assembly of said section. Although the rewind cradle assembly is adapted to be pivoted mechanically, it is most desirable that the cutter assembly be manually pivotable to permit accurate alignment thereof without expensive automation. Also, it is preferable to provide manually operable means for rocking the roll forming means, into and out of the rewind cradle assembly and thereby reduce the complexity and cost of the apparatus. The unwind first section of the apparatus may have means for ejecting the supply roll therefrom when the desired length or lengths have been removed therefrom.

For movably supporting the cutter assembly to permit the relative pivoting thereof, the center or second section of the apparatus may be pivotally connected to the unwind first section and mounted on wheels so as to be mobile. The rewind third section may be pivotally connected to the center section and mounted on wheels to permit the relative pivotal adjustment of the cradle assembly of said section. Since the center section is mobile, the means for imparting pivotal movement to the rewind section extends between and connects the rewind section to the unwind section which, preferably, is stationary. As used herein, the word "roller" includes rotatable supporting means having continuous cylindrical exteriors as well as the illustrated wheels or spaced narrow rollers.

BRIEF DESCRIPTION OF THE DRAWINGS

FIG. 1 is a perspective view of a roll unwind-rewind apparatus constructed in accordance with the invention and taken from the far right end of FIG. 4.

DESCRIPTION OF A PREFERRED EMBODIMENT

Figures 10, 11:
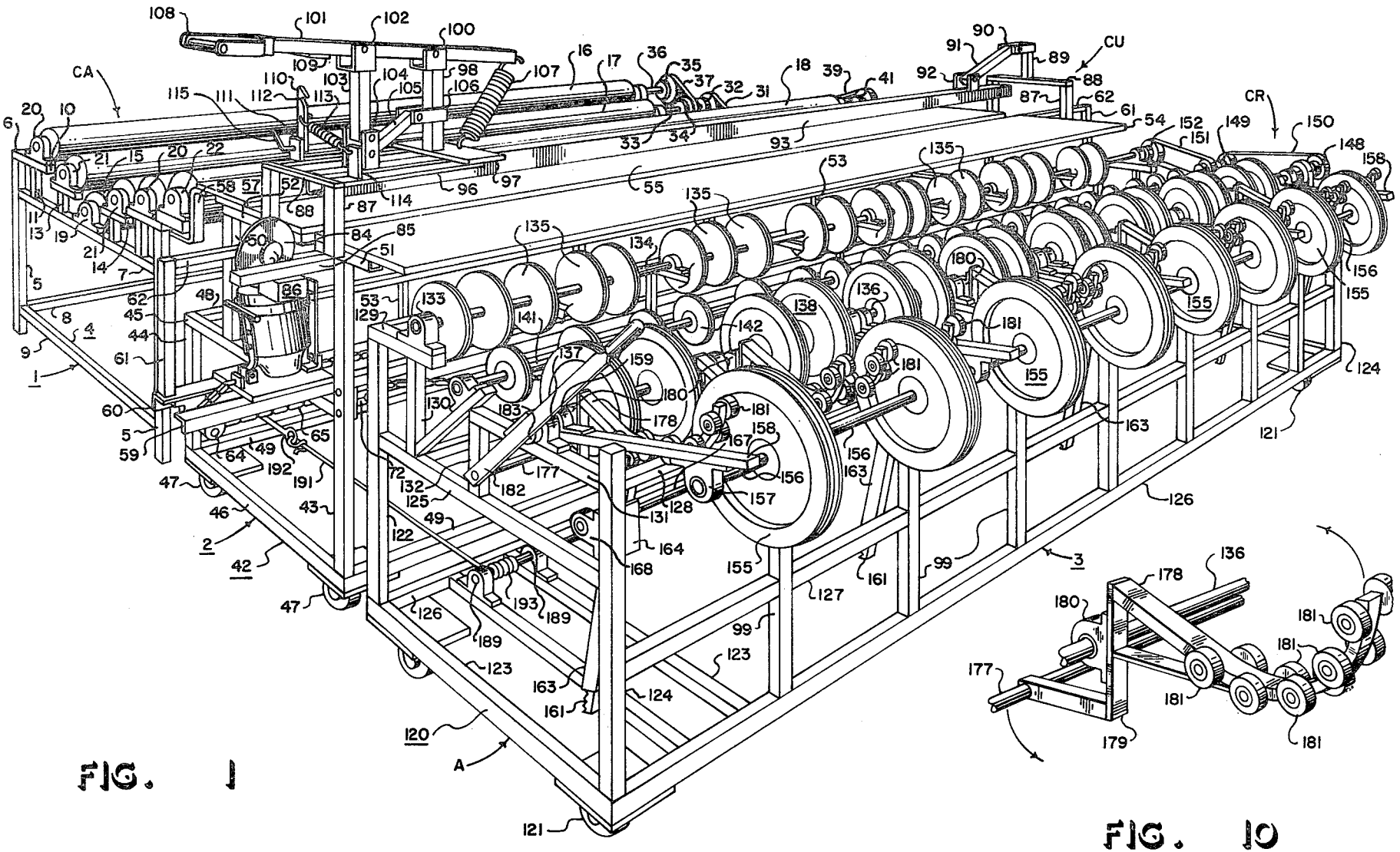
FIG. 10 is a perspective view, on an enlarged scale, of one of the arcuate rocker arms and its mounting.

In the drawings, the letter A designates a roll unwind-rewind apparatus embodying the principles of the invention for unwinding and cutting a predetermined length of rolled material C (FIG. 2) from a supply roll S thereof and rewinding the unwound material into a roll R. This material may be carpet or other relatively flexible or pliable rolled sheet material. Roll-unwind rewind apparatus A (FIGS. 1–4) is composed of a stationary unwind feed or supply (first) section 1 for rotatably supporting the supply roll S of material C, a mobile center or middle support (second) section 2 (FIG. 5) for receiving said material from said supply roll and supporting it during measuring and cutting a desired length therefrom, and a movable discharge or rewind (third) section 3 for receiving said cut length of material from the mobile center section and rotatably supporting it during rewinding thereof into roll R preparatory to dumping the latter.

As will be apparent hereinafter, apparatus A has a multiplicity of shafts and electric motors for imparting rotation to various portions thereof. Chain and sprocket drives are preferred for transmitting rotation from the motors to the shafts and between said shafts as well as to and from speed reducers interposed between said motors and shafts since they are not subject to slippage. It is noted, however, that belts and pulleys or sheaves could be substituted for the chains and sprockets and that belt and chain drives are interchangeable for the purposes of this disclosure. Also, the speed reducers could be of the gear type having direct drive connection to the motors. For clarity of illustration, belt drives are shown in some of the drawings, and the belts may be of the type having a corrugated or toothed inner surface for complementary engagement with sprockets or cog wheels.

Figure 2:
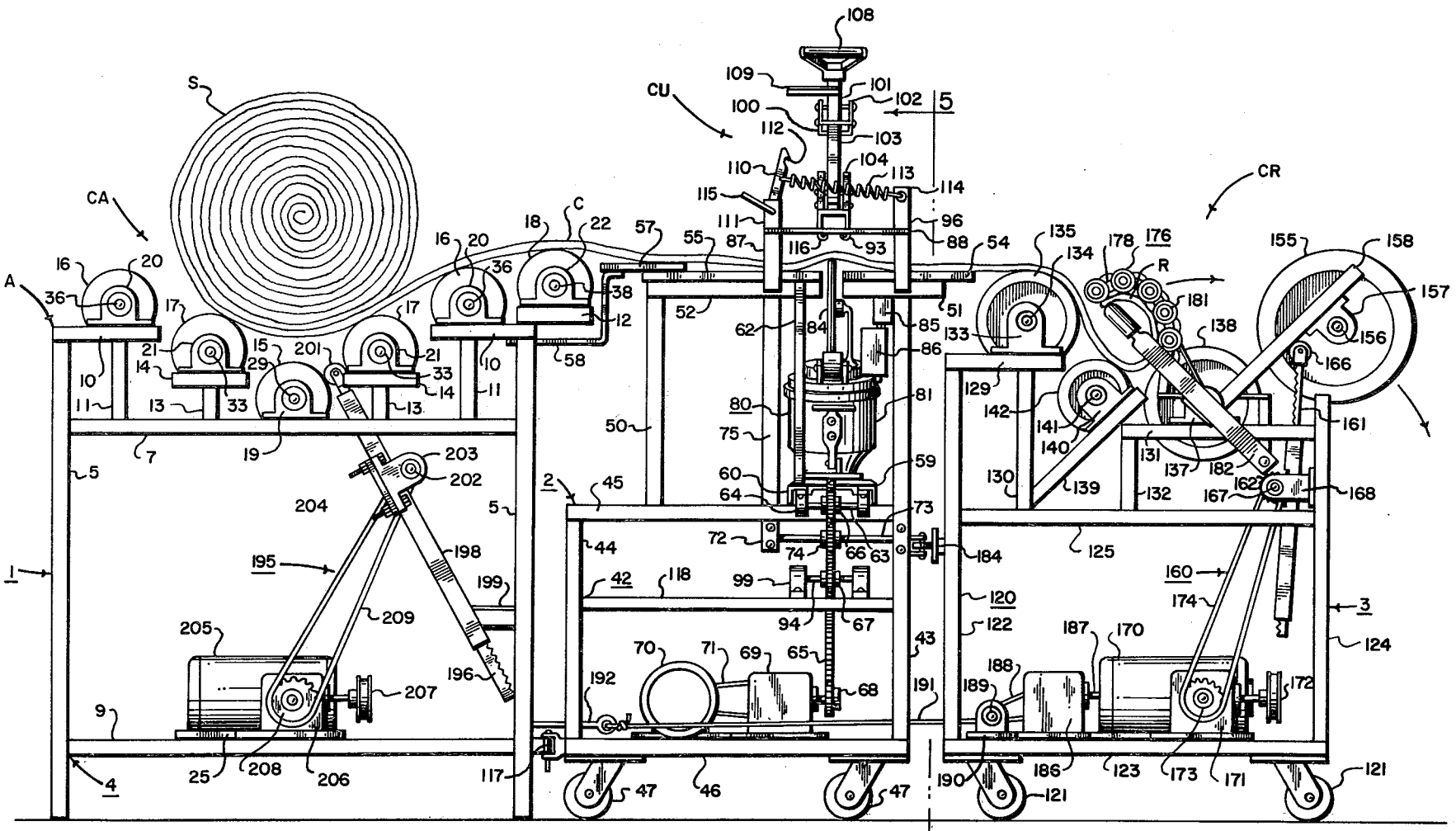
FIG. 2 is an elevational view, on an enlarged scale, of the left or near end (FIG. 1) of the apparatus showing the unwind and rewind cradle assemblies and a supply roll of carpet partially unwound and being rewound.
Figure 3:
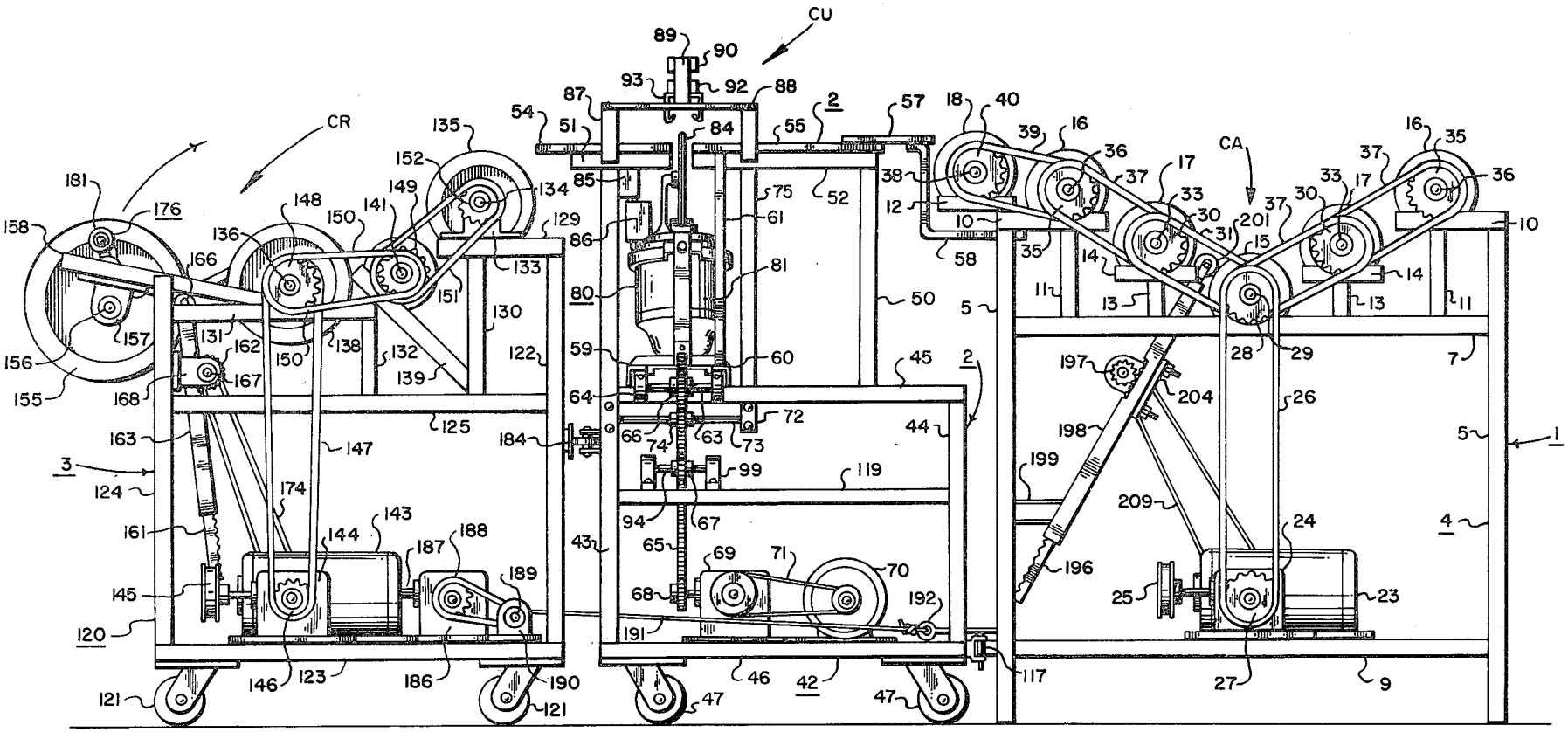
FIG. 3 is a far or right end (FIG. 1) elevational view of said apparatus, on an enlarged scale, and similar to FIG. 2.

A generally rectangular frame 4 is provided for stationary feed or supply unwind (first) section 1 of the apparatus and comprises spaced pairs of spaced upright end or corner legs or standards 5 supporting spaced pairs of spaced parallel horizontal longitudinal bars or members 6, 8 which respectively connect the upper ends and lower portions of the spaced pairs of legs. Similar horizontal transverse or end frame members or bars 7, 9, respectively connect the intermediate and lower portions of each pair of end legs 5 of rectangular frame 4, preferably in generally coplanar relation to upper and lower longitudinal frame members 6, 8; while additional lower transverse frame members (not shown) may be provided to connect and reinforce said lower longitudinal members 8 at intervals between the ends thereof. Horizontal transverse arms or short frame members 10 project laterally inward toward the center of the frame from the upper ends of each pair of frame legs 5 in generally parallel overlying aligned relation to each of the end or transverse upper frame members 7 and are connected thereto by upright legs or brace members 11 extending therebetween inwardly of and adjacent said legs. Preferably, horizontal arms 10 are coplanar with upper longitudinal frame members 6, and upright legs or brace members 11 may be spaced from the inner extremities of said horizontal arms. A similar parallel overlying horizontal arm 12 has its inner end portion secured to and projecting from the outer end portion of the arm 10 which is adjacent inner leg 5 of each spaced pair thereof. As shown in FIGS. 1, 2, 3, a spaced pair of upright short legs or stub members 13 upstand from the medial portion of each transverse upper frame member or bar 7 between each pair of upright legs 11 for supporting horizontal arms 14 similar to and below arms 10.

A cradle assembly CA is provided for supporting the supply roll S of material as shown in FIG. 2 and includes a plurality of elongate horizontal parallel rollers 15, 16, 17, 18, the centermost and lowermost roller 15 having its reduced end portions or its shaft rotatably supported or journaled in pillow blocks 19 upstanding from and resting upon the center portions of transverse upper frame members 7. One of the pair of rollers 16 is disposed at each of the lateral margins or sides of cradle assembly CA with its reduced ends or shafts rotatably supported or journaled in pillow blocks 20 which upstand from the inner end portions of arms 10. Upright pillow blocks 21 rotatably support the reduced ends or shafts of the pair of intermediate rollers 17, and these pillow blocks are mounted atop the pair of short legs or stub members 13. Innermost and uppermost roller 18 has each of its reduced ends or its shaft journaled in a pillow block 22 overlying and mounted on one of the horizontal arms 12 and is adapted to advance the unwound material to the second or center section 2. As shown, each of the rollers 15, 16, 17, 18 may be of unitary construction and have continuous cylindrical exteriors. If desired, however, each roller may be composed of two or more sections or a multiplicity of spaced wheels or narrow rollers mounted on and driven by a common shaft in the manner disclosed by the prior art as well as hereinafter.

As best shown in FIG. 3, the rollers of cradle assembly CA are adapted to be driven by an electric motor 23 and speed reducer 24 which are suitably supported at the lower far or right end (FIG. 1) of frame 4 of stationary unwind section 1 of roll apparatus A, and connected to each other by a chain and sprocket or belt and sheave drive 25. Upright endless chain or belt 26 connects respective drive and driven sprockets or sheaves 27, 28 and is fixed on the far right (FIG. 1) or left (FIG. 4) reduced end or axial shaft 29 of center roller 15. Sprockets or sheaves 30 fixed on shaft 29 have driving engagement with a pair of endless chains or belts 31 which are drivingly connected to sprockets or sheaves 32 carried by axial shafts 33 of intermediate rollers 17. A sprocket or sheave 34 is mounted on each shaft 33 for driving connection with sprockets or sheaves 35 fixed on the (FIG. 4) left reduced ends or axial shafts 36 of rollers 16 by endless chains or belts 37. Innermost and uppermost roller 18 has its left reduced end portion or left end of its axial shaft 38 drivingly connected to shaft 36 of adjacent roller 16 by an endless chain or belt 39 and sprockets or sheaves 40, 41 fixed on said shafts 36, 38, respectively. Due to this drive arrangement all of the rollers of cradle assembly CA are rotated clockwise (FIGS. 1, 3) at the same rate of speed to unwind the supply roll S supported thereby and feed the material C from said assembly to center support (second) section 2 of apparatus A for measuring and cutting a predetermined length of said material.

Mobile center support section 2 of the roll unwind-rewind apparatus is movable and includes a rectangular frame 42 having a pair of upright end or corner legs or standards 43, of greater height than the end or corner legs 5 of rectangular frame 4 of feed unwind section 1, coacting with a pair of shorter corner legs 44 adjacent said legs 5 to support horizontal cross or transverse end frame members or bars 45, 46 between their respective upper and lower portions (FIGS. 1-5). Lower horizontal end frame members 46 are in generally coplanar relation to the lower longitudinal and end frame members 8, 9, and each horizontal upper end member 45 of rectangular frame 42 has one of its ends fastened to the intermediate portion of each of the pair of longer corner legs 43. Suitable casters or wheels 47 are provided, one at each corner of frame 42, to permit adjustment of movable section 2 relative to the unwind (first) section and its right angular or "square" relationship to the unwound material. Horizontal longitudinal bars or frame members 48, 49, similar to longitudinal frame members 6, 8, extend between and connect the upper end and lower portions, respectively, of corner frame legs 43, 44 (FIGS. 1, 5) with upper longitudinal members 48 being above and below said upper longitudinal members 6 due to the respective longer and shorter lengths of said corner legs. An upright leg or stub member 50 upstands from each upper horizontal end frame member inwardly of adjacent shorter corner leg 44 and to the height of the upper end of longer leg 43.

A horizontal transverse arm or frame member 51 projects inwardly from the upper end of each leg 50, and each adjacent corner leg 43 has a horizontal arm 52 mounted thereon in spaced longitudinal alignment with the arm 51 so as to provide a gap between the inner ends thereof. One or more intermediate or medial upright legs or standards 53 (FIG. 5), similar to end or corner frame legs 43, are provided for reinforcing the center portions of horizontal members 48, 49 of frame 42, and the center portions (not shown) of the upper and lower longitudinal frame members 6, 8 may be reinforced in the same manner. Also, similar horizontal reinforcing members (not shown) may be provided between each lower pair of longitudinal frame members 8-9 and 49-49. As shown in FIG. 1, intermediate upright legs 53 may be provided also between the corner legs for reinforcing the upper and lower longitudinal members of frame 42 which are adjacent longitudinal members 6, 8 of frame 4.

Figure 5:
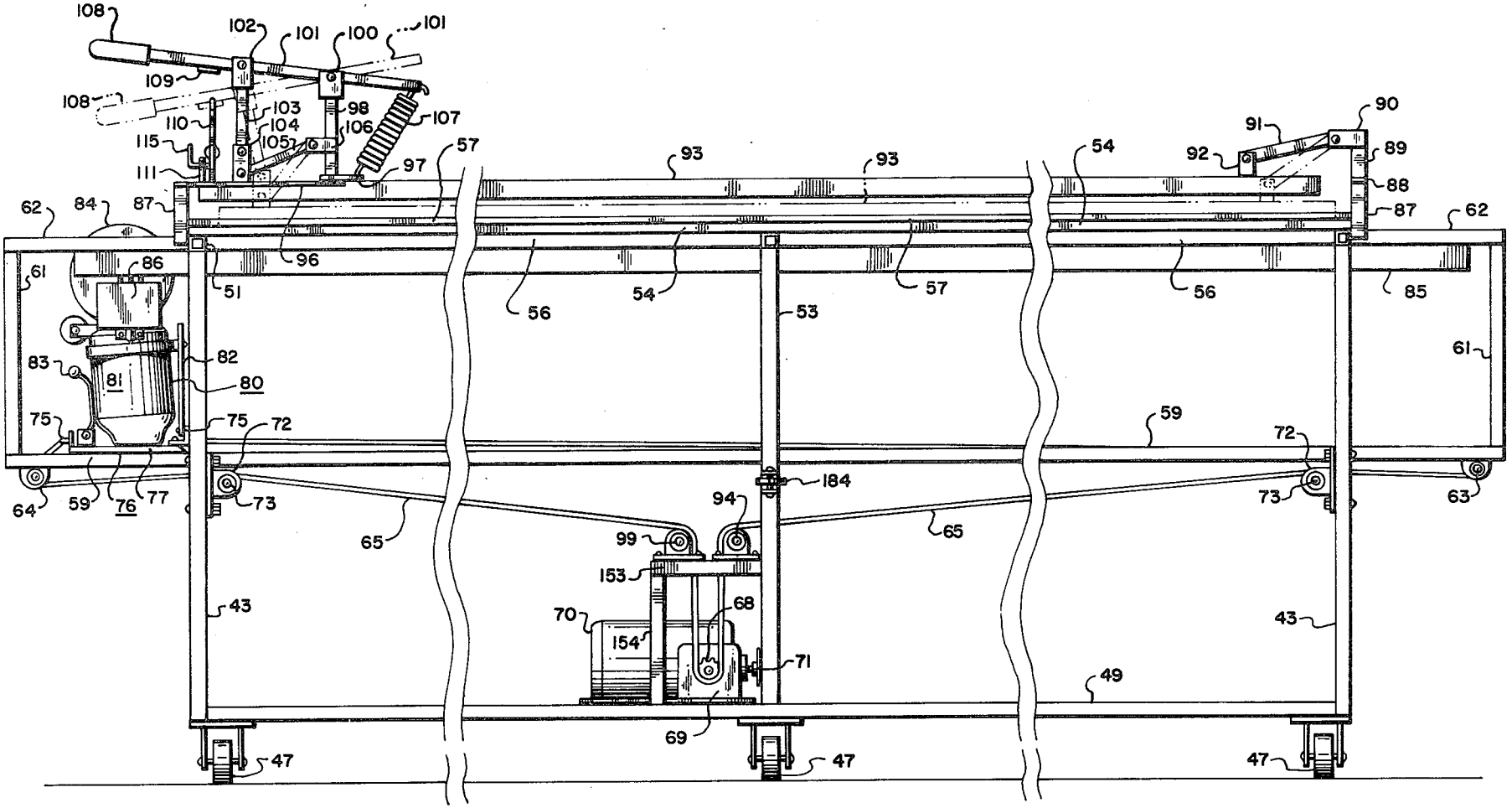
FIG. 5 is a broken side elevational view, taken on the line 5—5 of FIG. 2, showing the center section of said apparatus, its holddown mechanism and travelling cutter assembly.

For supporting the material C during measuring and cutting thereof, a pair of horizontal elongate relatively narrow flat members or plates 54, 55 extends longitudinally of the upper portion of frame 42 of mobile center support section 2 in spaced parallel coplanar relationship. The ends of support plates 54, 55 rest upon and are suitably secured to the upper horizontal transverse arms 51, 52 which overlie and are mounted on the respective upper ends of frame legs 43, 50. As shown in FIG. 5 only, longitudinal frame members or bars 56 connect the upper ends of each pair of legs 43, 50 in underlying engagement with the support plates. Support plate 55 is of greater width than plate 54 and has its outer longitudinal margin overlying and slidably engaging the inner longitudinal margin of a similar plate 57 so as to accommodate relative movement of said plate 55 upon adjustment of the position of support section 2 relative to section 1. Suitable angular brackets 58 (FIGS. 1, 2, 3) support overlying plate 57 and have their outer lower flanges underlying and secured to the adjacent upper horizontal arm 10 of frame 4. Preferably, the widths of plates 54, 55 are greater than the lengths of underlying transverse arms 51, 52, with the inner margins of said plates being aligned with the inner ends of said arms and their outer margins projecting beyond the outer ends of the latter.

Figure 4:
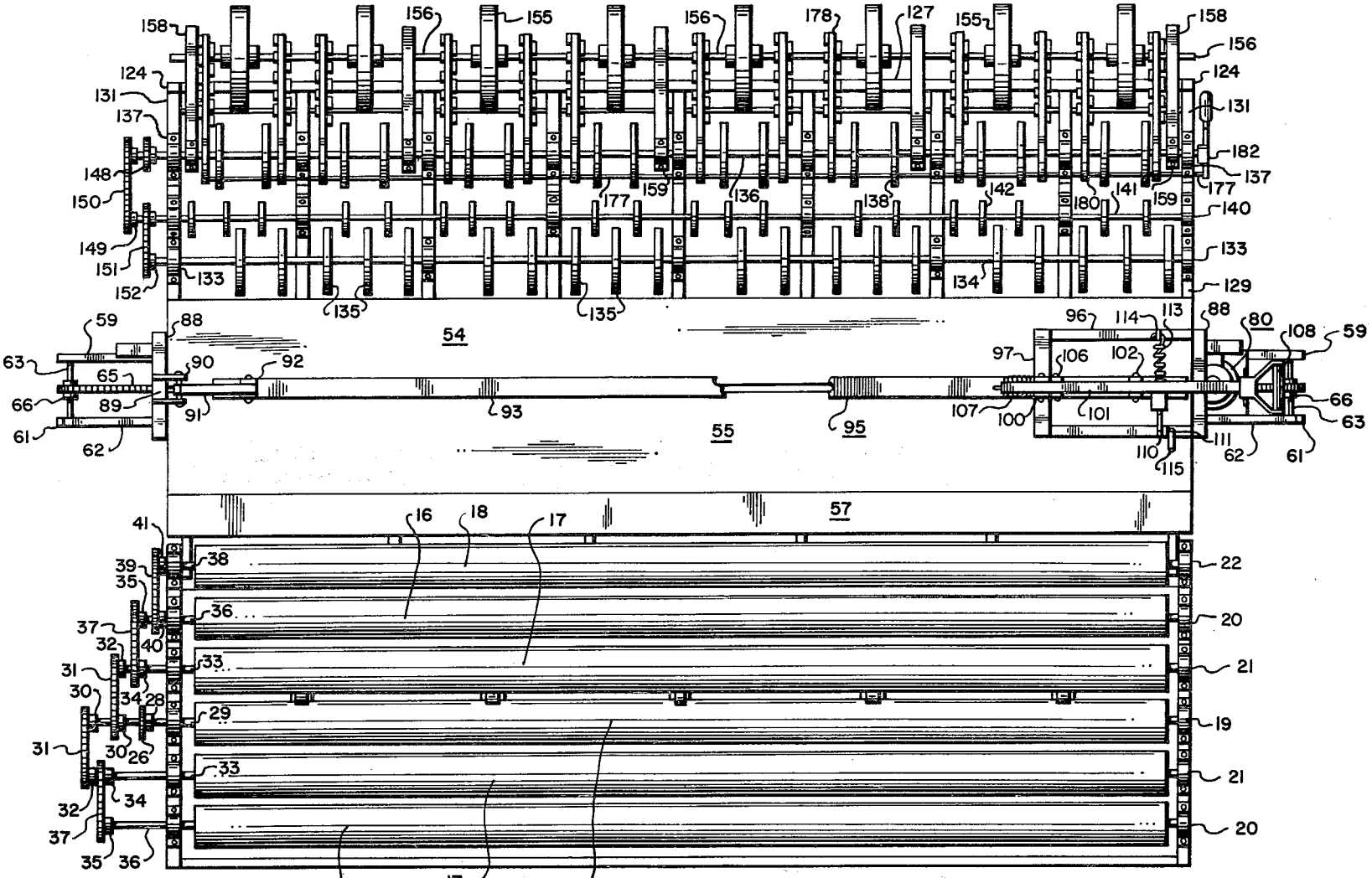
FIG. 4 is a top plan view, partly broken away to show the slot for the cutter.

A cutter assembly CU is adapted to be supported by apparatus mobile support section 2 and includes a pair of spaced parallel horizontal longitudinal angle bars or tracks 59, 60 resting upon and secured to upper end bars 45 adjacent longer corner legs 43. As best shown in FIGS. 4, 5, 8, 9, angle bars or track 59, 60 have their horizontal longitudinal flanges extending inwardly from the upper margins of the upright flanges of said angle bars toward each other. The tracks are of greater length than longitudinal frame members 48, 49 so as to project beyond the ends of frame 42 and the cutter assembly. An upright leg 61 upstands from each end of track 60 (FIGS. 1-5) adjacent each corner leg 5, and a short horizontal longitudinal frame member of arm 62 connects its upper end to the inner end portion of each upper transverse arm 52. As shown in FIGS. 1, 4, 5, the end portions of tracks 59, 60 are connected to each other by a horizontal transverse shaft 63 having its ends rotatably supported or journaled in pillow blocks 64 depending from said end portions.

A chain or belt 65 is trained around a sprocket or sheave 66 (FIGS. 2, 3, 4) mounted on each shaft 63 between its pillow blocks 64. The lower flight of chain or belt 65 has its medial portion trained over a pair of sprockets or sheaves 67 and then downwardly therebetween (FIG. 5) around drive sprocket or sheave 68 of speed reducer 69 which is driven by a reversible electric motor 70 through chain and sprocket or belt and sheave drive 71. Sprockets or sheaves 67 are mounted on transverse horizontal shafts 94, each of which is rotatably supported at its ends by a pair of pillow blocks 99. Speed reducer 69 and motor 70 are suitably supported adjacent intermediate frame leg 53 by horizontal cross bars 118, 119 (FIGS. 2, 3), horizontal longitudinal bars 153 and upright legs 154 as shown in FIG. 5.

Preferably, one of a pair of pillow blocks 72 (FIGS. 1, 2, 3, 5) is mounted on each corner frame leg 43 immediately below the end portions of track 59 for rotatably supporting the ends of a horizontal transverse shaft 73 which has an idler sprocket or sheave 74 fixed on its medial portion. The other pillow block 72 of each pair is mounted on the lower end of an upright leg or frame member 75 (FIGS. 2, 3) which depends from the inner end portion of horizontal arm 52 adjacent leg 62, the upper end of the leg being secured to upper transverse arm 52. The end portions of the lower flight of chain or belt 65 are supported by idler sprockets or sheaves 74 in coaction with end sprockets or sheaves 66.

Figure 8:
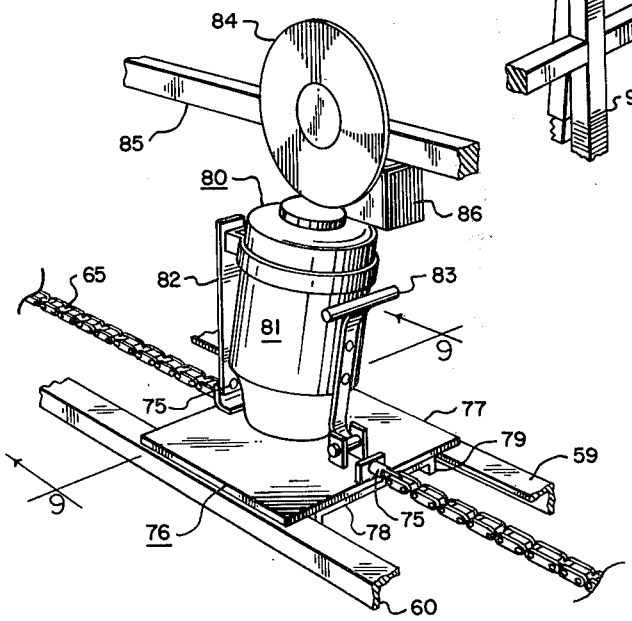
FIG. 8 is a broken perspective view of said travelling cutter assembly, its carriage and portions of its drive chain and track.
Figure 9:
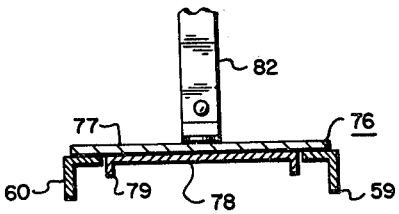
FIG. 9 is a transverse vertical sectional view taken on the line 9—9 of FIG. 8.

As shown at 75 in FIGS. 1, 8, the ends of the chain or belt are secured to the opposite ends of a carriage or dolly 76 which is slidably mounted on tracks 59, 60 for reciprocal rectilinear movement and which has a flat rectangular base member or plate 77 with its lateral margins resting upon the horizontal inwardly extending upper flanges of said tracks so as to ride upon said flanges. A more narrow rectangular flat plate 78, having upright flanges 79 (FIG. 9) depending from its lateral margins, is secured to the underside of base plate 77 and spans the distance between the upper flanges of the tracks. Carriage 76 forms a part of cutter mechanism 80 which includes an electric motor 81 mounted on the base plate of said carriage by suitably upright supports 82, 83 and an upright circular rotary blade 84 which may have a serrated or toothed periphery. The blade 84 is rotatable about a horizontal axis and its vertical or upright plane of rotation is centered in the gap between support plates 54, 55 (FIGS. 2, 3). An elongate horizontal electrical rail or member 85 is secured to the upper end portions of corner legs 43 and center leg 53 and/or to the undersides of transverse arms 51 (FIGS. 1–6) and has its ends projecting outwardly beyond said corner legs. The electrical motor 81 carries a suitable contact element 86 which is in constant slidable engagement with electrical rail 85 for transmitting electrical energy to said motor throughout its reciprocal movement by reversible motor 70 with carriage 76. As shown in FIGS. 1, 4, 5, cutter mechanism 80 is adapted to be positioned at either end portion of tracks 59, 60 outwardly of frame 42 when not in use. Although omitted for clarity of disclosure, limit switches are adapted to be mounted at the ends of the tracks for engagement by carriage 76 or a contact. Prior patents, such as Lee, supra, disclose the type and mounting of the switches.

A pair of short upright legs or stub members 87 upstand from each pair of horizontal arms 51, 52 for supporting the ends of a horizontal flat cross bar or member 88 in overlying parallel relation to said arms so as to straddle the gap between the support plates. One of the bars 88 (FIG. 3, at right end of FIGS. 1, 5 and at left end of FIG. 4) and has an upright post of stub member 89 upstanding from its medial portion, and a pair of horizontal closely-spaced short arms 90 are secured to and project inwardly from the upper end of the post. A link 91 pivotally connects the inner ends of arms 90 to a pair of upright apertured ears or lugs 92 at the corresponding end portion (left FIGS. 1, 5 and right FIG. 4) of an elongate inverted channel-shaped guide member or bar 93 so as to suspend the latter in overlying longitudinal relation to the gap or space between support plates 54, 55. In addition to serving as a guide for cutter blade 84, elongate member 93 also functions as a part of holddown mechanism 95 for preventing movement of material C during the cutting thereof.

A pair of overlying spaced horizontal flat bars or arms 96 is secured to and projects inwardly from the end portions of cross bar 88 at the near or left end (FIGS. 1, 5) of the guide member, and the inner ends of the arms are connected by an overlying horizontal flat cross bar 97. An upright member or post 98 projects upwardly from the medial portion of cross bar 97 and has a yoke 100 at its upper end pivotally connected to the inner end portion of a level 101. This lever has its intermediate portion pivotally attached by a yoke 102 to the upper end of an upright arm or link 103 which has its lower end pivotally attached to another yoke 104 secured to and upstanding from the adjacent end portion of guide member 93. A lower arm or link 105 has its outer end pivoted to upstanding yoke 104 and its inner end pivoted to a yoke 106 projecting outwardly from the lower portion of post 98 in spaced relation to cross bar 97. The inner extremity of lever 101 is secured by a helical spring 107 to the medial portion of cross bar 97 for resiliently maintaining holddown guide member 93 in its upper position.

A suitable handle 108 may be provided at the outer end of lever 101, and an adjacent keeper bar or element 109 projects laterally from said lever for coacting with an upright hook or latch member 110 which has its lower end pivotally connected to an apertured ear or lug 111 upstanding from the outer end portion of one of arms 96 (left in FIGS. 1, 2) for locking the guide member in its lowermost holddown position. Latch member 110 has a bill or hook 112 at its upper end portion adapted to be engaged by keeper bar 109 (FIG. 5) when the lever is swung downwardly so as to lock said lever against upward clockwise movement by spring 107. For releasably maintaining hook 112 of the latch member in engagement with the keeper bar, a helical spring 113 pivotally connects the medial portion of said member to another apertured ear or lug 114 which upstands from the other or right arm 96 (FIGS. 1, 2) in spaced parallel relation to lug 111. Latch member 110 has an angular lever 115 projecting laterally therefrom through and rotatably supported by lug 111 for manual pivoting of said member out of its locking position.

As shown in broken lines in FIG. 5, downward movement of handle 108 pivots lever 101 counterclockwise about the axis of yoke 100 at the top of post 98, upper link 103 moves downwardly and pivots in the same general direction about the axis of lower yoke 104, and lower link 105 moves downwardly and pivots counterclockwise about the axes of its yokes 104, 106 relative to said link 103 and post 98. This movement also pivots link 91 (at right end of FIGS. 1, 5 and at left end of FIG. 4) counterclockwise downwardly about the axes of its yokes 90, 92 so as to swing guide member 93 into its lower holddown position for engaging material C and is locked in this position by engagement of latch bar 109 with latch member 110 until the latter is released.

As best shown in FIGS. 4, 5, the holddown guide member is of less length than the longitudinal distance between corner legs 43-43 and 44-44 and this length is at least not less than the width of material C. Preferably, member 93 and support plates 54, 55 are of the same length and coact to clamp the material therebetween so as to prevent relative movement therof during its cutting. Also, it is preferably to provide inwardly upturned coextensive lips 116 (FIGS. 2, 3) at the lower margins of the opposed flanges of the guide member to prevent the possibility of snagging material C as well as harmful engagement with cutter blade 84. Although not illustrated, it is readily apparent that a suitable meter, similar to the meters of Malone patents Nos. 3,386,678 and 3,917,183 may be mounted adjacent one end of cutter assembly CU to measure the carpet or other material prior to cutting thereof.

As shown at 117 in FIGS. 2, 3, the respective frames 4, 42 of stationary supply and mobile center sections 1, 2 are pivotally attached at the centers of their respective lower longitudinal frame members 8, 49 for relative movement of said section 2 about an upright axis. Accordingly, the center section may be pivoted manually so as to position blade 84 of cutter assembly CU at a right angle to the longitudinal axis of material C whereby its travel and the cutting of carpet or other pliable material is perpendicular or "square" with the lateral ends or longitudinal margins thereof. When so positioned, the mobile section is adapted to be locked against displacement relative to the material by the aforesaid actuation of holddown guide member 93.

The movable rewind section 3 (FIGS. 1–4) for receiving material C from support plate 54 of center section 2 and rewinding it into roll R includes a generally rectangular frame 120 mounted on casters or wheels 121, one at each corner, to permit adjustment of the position of said rewind section 3 relative to said center section and the right angular or "square" relationship of said roll. A pair of spaced upright end legs 122, similar to but of less height than the legs of apparatus sections 1, 2, are provided at the inner corners of frame 120 and their lower ends are connected by horizontal transverse or end frame members or bars 123 to the lower ends of still shorter but similar legs 124 at the outer corners of said frame. A similar end bar or transverse member 125 extends between the intermediate portions of each set of inner and outer corners legs 122, 124 in overlying spaced parallel relation to each lower transverse member or end bar 123.

A trio of spaced horizontal longitudinal frame members or bars 126, 127, 128 (FIG. 1) respectively connect the lower end intermediate and upper end portions of the inner and outer corner legs as well as similar intermediate legs 99. It is noted that each intermediate longitudinal frame member 127 is formed by a plurality of short bars secured to legs 99, 124. Each inner corner leg 122 has a horizontal arm or short frame member 129 (FIGS. 2, 3) projecting transversely inward of frame 120 from its upper end, and the inner end portion of each arm is reinforced by an underlying upright leg or post 130 upstanding from the intermediate portion of each transverse member or end bar 125.

A horizontal transverse frame member or end bar 131 projects inwardly of frame 120 (FIGS. 2, 3) from the upper end portion of each outer corner leg 124, which is shorter than inner legs 122, in parallel spaced relation to each intermediate end bar 125 and terminates at approximately the transverse center of said frame. The inner end of each upper bar 131 is supported by an upright frame member or leg 132 upstanding from the intermediate end bar. A pillow block 133 overlies and is fastened to the inner end portion of each horizontal arm 129 for rotatably supporting the ends of a horizontal shaft 134 extending longitudinally of the aforesaid frame and having a multiplicity of spaced wheels or roller 135 (FIGS. 1–4) fixed thereon for rotation therewith. A similar parallel shaft 136 has its ends journaled in pillow blocks 137 upstanding from the medial portions of horizontal bars 131 and carries a multiplicity of spaced wheels or rollers 138 of larger diameter than wheels 135. From the lower end of each upright leg 130, an inclined frame member or bar 139 extends upwardly past the inner end of each bar 131 and has a pillow block 140 mounted on its upper end portion for supporting one end of a shaft 141 between and parallel to shafts 134, 136. A multiplicity of spaced wheels or rollers 142, of less diameter than wheels 135 of shaft 134, are fixed on shaft 141 in offset overlapping relation to said wheels 135. For supporting the intermediate portions of shafts, 134, 136, 141, between the ends of frame 120, the subframe structure represented by frame members 123, 125, 129, 130, 131, 132 (FIGS. 1, 2) is provided at spaced intervals, such as at intersections of intermediate legs 99 with longitudinal frame members 126, 127, 128.

As shown in FIG. 3, an electric motor 143 and speed reducer 144 are suitably mounted at the lower left end portion of frame 120 adjacent lower end bar 123. This motor and speed reducer are drivingly connected by a chain and sprocket or belt and sheave drive 145, and drive sprocket or sheave 146 of speed reducer 144 is connected by an endless chain or belt 147 to the inner one of a pair of sprockets or sheaves 148 mounted on the left end (FIG. 4) of shaft 136. The adjacent end of adjacent shaft 141 carries a similar pair of sprockets or sheaves 149, the outer one of which is connected by a similar chain or belt 150 to the outer sprocket or sheave 148 of shaft 136. An endless chain or belt 151 connects the inner sprocket 149 to a sprocket or sheave 152 mounted on the left end of shaft 134. The shafts 136, 141, 134 and their respective rollers or wheels 138, 142, 135 are adapted to be driven (clockwise FIG. 3, counterclockwise FIG. 2) at the same constant speed and in the same direction as roller 18 and rollers 16, 15, 14 of cradle assembly CA for receiving material C from support plate 54 of section 2 of the apparatus.

Since outer corner legs 124 are shorter than inner corner legs 122 (FIG. 2) so as to dispose outer horizontal arms 131 and pillow blocks 137 below horizontal arms 129 and pillow blocks 133, shaft 136 and its wheels 138 are positioned below shaft 134 and its wheels 135. Likewise, the mounting of pillow blocks 140 on inclined bars 139 disposes shaft 141 and its wheels 142 below shaft 134 and its wheel 135, said shaft 141 being slightly above shaft 136. Of course, the uppermost portions of wheels 135 are generally coplanar with the upper side of support plate 54. For coacting with wheels 135, 141, 138, a multiplicity of spaced wheels or rollers 155 (FIGS. 1–4, 7) are mounted on an outer horizontal shaft 156 extending longitudinally of the upper outer margin of frame 120 adjacent and parallel to upper outer frame member 128. Outer shaft 156 is rotatably supported by spaced pillow blocks 157 secured to the underside of the outer ends of a plurality of elongate arms or members 158 extending transversely between said outer shaft and inward shaft 136. Pillow blocks 159 upstand from the inner ends of arms 158 for rotatably connection with inward shaft 136 at spaced intervals between its wheels 138, whereby said arms are pivotally attached to said inward shaft so as to permit rocking or pivotal movement of the outer shaft 156 and its wheels 155 about the axis of said inward shaft between its inner upper position shown in FIGS. 1, 2 and the outer lower position of FIG. 3. The arms are adapted to be supported in such lower position by having their outer end portions resting upon the uppermost outer longitudinal member of frame 120.

For movably supporting elongate arms 158, a lifting mechanism 160 is provided and includes a multiplicity of upright elongate racks 161 and pinions 162. As best shown in FIGS. 2, 3, each rack 161 is slidably mounted within a complementary casing or housing 163 which is secured by a suitable bracket 164 to the inner upper portion of each of adjacent outer legs 124, 99 (FIGS. 1, 7) and which has a rectangular opening 165 to accommodate meshing of pinion 162 with said rack. A caster or small wheel 166 is mounted on the upper end of each rack for rotatably engagement with the underside of each elongate arm so as to facilitate relative sliding movement of said arm. Pinions 162 are fixed on a horizontal shaft 167 extending longitudinally of frame 120 and rotatably supported by pillow blocks 168 mounted on the inner upper portions of outer legs 124, 99 adjacent brackets 164.

Figure 7:
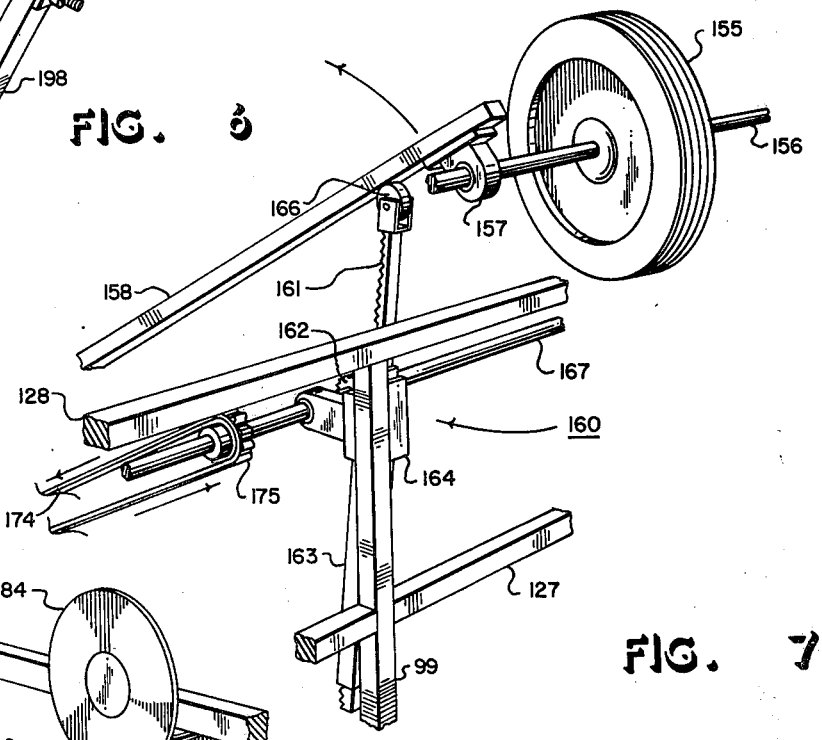
FIG. 7 is a broken perspective view of a portion of the rewind section of said apparatus illustrating the mechanism for the outer roller of its cradle assembly between portions supporting and dumping the rewound roll.

Upon counterclockwise rotation (FIGS. 1, 2, 7) of shaft 167, pinions 162 impart upward lengthwise movement to racks 161 so as to pivot arms 158 counterclockwise upwardly and swing wheels 155 and shaft 156 to the upper position of FIGS. 2, 7, whereby said wheels coact with wheels 135, 142, 138 of shafts 134, 141, 136 to provide a cradle assembly CR for roll R of material C.

Lifting mechanism 160 includes an electric motor 170 and speed reducer 171 (FIG. 2) suitably mounted at the lower portion of frame 120 adjacent one of the outer intermediate legs 99 and its adjacent lower cross bar 123. A chain and sprocket or belt and sheave drive 172, similar to drives 25, 71, 145, drivingly connects motor 170 and speed reducer 171, and drive sprocket or sheave 173 of said speed reducer is connected by an endless chain or belt 174 to a sprocket or sheave 175 (FIG. 7) fixed on shaft 167. Motor 170 is reversible so as to permit reversal of the direction of rotation of the shaft and its sprocket or sheave 175 as well as pinions 162 for reciprocating racks 161 upwardly and downwardly and thereby raise and lower shaft 156 and its wheels 155.

For commencing the formation of roll R, a coiling mechanism 176 (FIG. 1, 2, 4) is provided and includes a cylindrical rod or rock shaft 177 extending longitudinally of frame 120 of movable section 3 of roll apparatus A for supporting a multiplicity of spaced arcuate arms or rockers 178 which extend laterally from the rock shaft. Angular brackets 179 rigidly connect the inner portions of rockers 178 to rock shaft 177, and the inner ends of the brackets are rotatably supported by pillow blocks 180 secured thereto and journaled on shaft 136 whereby said arms project laterally outward therefrom for pivotal movement about the axis thereof upon rocking of said rock shaft transversely of frame 120. Each rocker has a multiplicity of opposed small rollers or casters 181 mounted on its lateral sides for rotation about horizontal axes parallel to the axis of the rock shaft. As shown, it is desirable to offset or stagger rollers 181 on opposite sides of said arm.

A handle 182 has its lower end fixed on the near or left end (FIGS. 1, 2) of rock shaft 177 and is rotatably supported at its medial portion by a pillow block 183 fixed thereto and journaled on the end of shaft 136 adjacent pillow block 137 to permit manual operation of roll coiling mechanism 176 for swinging its arcuate arms or rockers 178 inwardly from a position between wheels 155 (FIG. 3) to an elevated position (FIG. 2) for engagement with the leading edge of material C as its rides over wheels 135, 141 of respective shafts 134, 140 so as to coil said material. Wheels 135, 142 of respective shafts 134, 141 support and convey the material during its travel from support plate 54 to wheels 138 of shaft 136. As soon as roll R is formed sufficiently, handle 182 is released so as to permit outward clockwise pivoting of coiling mechanism 176 to its inoperative position (FIGS. 1, 3) with its arms 178 between wheels 155 and below the uppermost peripheral portions of said wheels. For clarity, most of the roll coiling mechanism has been omitted from FIG. 3.

In order to permit adjustment of the position of movable rewind section 3 relative to center section 2 of the roll winding apparatus, the medial portion of frame 120 is pivotally attached to the medial portion of outer center leg 53 of said center section below its intersection with outer intermediate longitudinal frame member 42 as shown at 184 in FIGS. 2, 3, 5. Pivotal attachment 184 may be of any suitable construction so long as its axis of rotation is generally perpendicular or upright and is disposed between the aforesaid apparatus sections generally at their center portions, whereby the angular relationship of the rewind section may be adjusted in accordance with the angular relationship between material C and cradle assembly CR. For controlling the pivotal movement of section 3, a speed reducer 186 and its reversible electric motor (not shown) are mounted at the lower medial portion of frame 120 (FIGS. 2, 3) and are adapted to be connected by a suitable drive; a portion of the latter is indicated at 187. A similar drive 188 connects speed reducer 186 to an elongate shaft 189 extending longitudinally of the rewind section and its end portions journaled in pairs of pillow blocks 190 suitably mounted on a closely spaced pair of the intermediate lower cross bars 123 adjacent their intersections with the inner lower longitudinal frame member 128.

Cables or ropes 191 (FIGS. 1, 3) extend transversely between stationary section 1 and movable rewind section 3 and the outer end of each cable is attached to an eye bolt 192 extending outwardly from lower longitudinal frame member 8 of unwind section 1 across frame 42 of center section 2. As shown in FIG. 1, the inner ends of cables 191 are wound in coils or helices 193 around the end portions of shaft 189 between adjacent pillow blocks 190. The convolutions of coils 193 extend in opposite directions, whereby rotation of the shaft in one direction continues winding of one of said coils thereon so as to pivot the adjacent end of rewind section toward center section 2 and simultaneously unwinds the other coil to permit pivoting of the other end of said movable section away from said center section. In addition to adjusting the angular relationship of section 3, the reversible motor of speed reducer 186 is adapted to maintain such relationship until said motor is reactivated.

Figure 6:
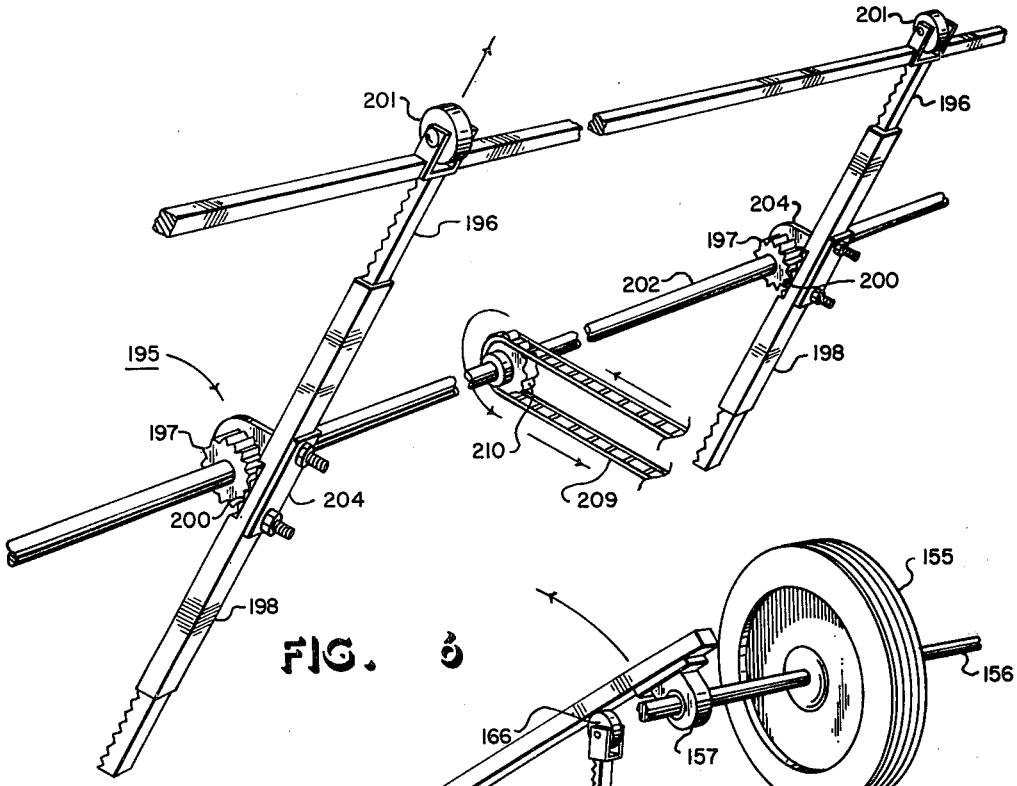
FIG. 6 is a broken perspective view of a portion of the mechanism for ejecting supply roll from said unwind cradle assembly adapted to rotatably support said roll as shown in FIG. 2.

It is desirable to provide an ejecting mechanism 195 (FIGS. 2, 3, 6) for assisting the removal of supply roll S from cradle assembly CA after a desired length of material C has been unwound and cut therefrom. Ejecting mechanism 195 is similar to lifting mechanism 160 and has a multiplicity of similar upright elongate racks 196 disposed in spaced parallel relationship, similar spaced coacting pinions 197, and similar casings or housings 198 complementary to the racks and secured at their lower end portions by horizontal members 199 to frame 4 of unwind section 1 so as to extend transversely thereof at an upward outward inclination away from center section 2 between center roller 15 and inner roller 17. Although not illustrated, the upper end portions of housings 198 are adapted to be connected to frame 120, such as to the upper cross bars 7 between the ends of said frame. A rectangular opening 200, similar to opening 165 of housing 163 of each rack 161, is provided in each housing 198 to permit engagement of each rack 196 with its respective pinion 197. Each of the racks has a caster or small wheel 201, similar to casters 166, mounted on its upper end for engagement with the underside of the supply roll. As best shown in FIG. 6, a horizontal shaft 202, similar to shaft 167 (FIG. 7) and extending longitudinally of the lower portion of frame 4, has pinions 197 fixed thereon for rotation therewith. Shaft 202 is rotatably supported by pillow blocks 203 secured to housings 198 by angular brackets 204. Upon counterclockwise rotation (FIGS. 3, 6) of shaft 202, the pinions impart upward reciprocal movement to racks 196 for lifting supply roll S.

Ejecting mechanism 195 also comprises a reversible electric motor 205 and speed reducer 206 (FIG. 2) suitably supported at the lower medial portion of frame 4. A conventional chain and sprocket or belt and sheave drive 207 connects motor 205 and speed reducer 206, while drive sprocket or sheave 208 of the latter is connected by endless chain or belt 209 to a sprocket or sheave 210 (FIG. 6) fixed on shaft 202. Due to its reversibility, the motor is adapted to rotate the latter shaft and its pinions 197 clockwise as well as counterclockwise for reciprocating racks 196 downwardly as well as upwardly so as to disengage casters 201 from engagement with the supply roll.

We claim:

1. An apparatus for unwinding a predetermined length of pliable material, such as carpet from a supply roll, for measuring, cutting and rewinding the unwound length of material into a roll comprising first means having driven rollers forming a cradle for rotatably supporting a supply roll of pliable material and for unwinding and advancing a predetermined length thereof, second means for receiving the unwound material from the first means and supporting said material during measurement and severing of the predetermined length of material, the second means having means for severing the predetermined length of material and means for preventing movement of said material relative to the severing means during the cutting of said length thereof, said second means having means mounting said severing means for pivotal movement about an upright axis to permit alignment thereof with the transverse axis of said unwound length of material, third means for receiving said length of material from said second means and having driven rollers forming a cradle for rotatably supporting and rewinding said length of material, the rewind cradle being mounted for pivotal movement about an upright axis to permit continual orientation of said cradle relative to said length of material for squaring the ends thereof and preventing coning of said ends.

2. An apparatus as defined in claim 1 wherein said second means is mobile so as to provide the pivotal mounting for said severing means.

3. An apparatus as defined in claim 2 wherein said third means is movably supported so as to provide the pivotal mounting for its rewind cradle.

4. An apparatus as defined in claim 3 including means for imparting pivotal movement to said third means extending between and connecting said first and third means.

5. An apparatus as defined in claim 4 wherein said second means is pivotally connected to said first means.

6. An apparatus as defined in claim 5 wherein said third means is pivotally connected to said second means.

7. An apparatus as defined in claim 2 wherein said second means is pivotally connected to said first means.

8. An apparatus as defined in claim 1 wherein said third means is movably supported so as to provide the pivotal mounting for its rewind cradle.

9. An apparatus as defined in claim 8 including means for imparting pivotal movement to said third means extending between and connecting said first and third means.

10. An apparatus as defined in claim 9 wherein said third means is pivotally connected to said second means.

11. An apparatus as defined in claim 1 including means pivotally mounting the outermost driven roller of the rewind cradle for arcuate movement about a horizontal axis between an upper position to permit dumping of the rewound roll.

12. An apparatus as defined in claim 1 including rocker means mounted for pivotal movement about a horizontal axis into and out of the cradle of said third means so as to engage the advancing portion of said severed length of material and forming it into a roll.

13. A roll unwind rewind apparatus comprising first roller means for supporting a supply roll of pliable material, drive means for rotating the roller means to unwind and advance a predetermined length of the material, support means for receiving the unwound material from said roller means, the support means having means for severing a predetermined length from said unwound material and means for preventing movement of said material during severing of the predetermined length therefrom, said support means having means mounting the severing means for pivotal movement about an upright axis relative to said roller means to permit alignment of said severing means with the transverse axis of said unwound material, second roller means for receiving the severed length of material from said support means, drive means for rotating the second roller means to rewind said severed length of material, said second rewind roller means being mounted for pivotal movement about an upright axis relative to said support means for aligning said unwind roller means with the longitudinal axis of said rewound length of material so as to prevent coning of the ends thereof.

14. An apparatus as defined in claim 13 wherein said support means is movably supported so as to provide the pivotal mounting for said severing means.

15. An apparatus as defined in claim 14 wherein said support means has pivotal connection with said first roller means to permit said pivotal movement of said support means.

16. An apparatus as defined in claim 13 wherein said second rewind roller means has pivotal connection with said support means so as to permit the pivotal movement of said rewind roller means.

17. An apparatus as defined in claim 16 wherein said support means is movably supported so as to provide the pivotal mounting for said severing means.

18. An apparatus as defined in claim 16 including means for imparting pivotal movement to said second rewind roller means extending and connecting said first rewind and second rewind roller sections.

* * * * *